United States Patent [19]

Winberg et al.

[11] 3,979,921

[45] Sept. 14, 1976

[54] TUNNELING SHIELD

[75] Inventors: Douglas F. Winberg, Issaquah, Wash.; Norman D. Dyer, Beaumont, Tex.

[73] Assignee: Dresser Industries, Inc., Dallas, Tex.

[22] Filed: Dec. 9, 1974

[21] Appl. No.: 531,040

Related U.S. Application Data

[62] Division of Ser. No. 363,035, May 23, 1973, Pat. No. 3,870,368.

[52] U.S. Cl. ..... 61/85; 299/31

[51] Int. Cl.[2] ..... E21D 9/06

[58] Field of Search ..... 61/85, 84, 45, 42; 299/31, 33; 52/732

[56] References Cited

UNITED STATES PATENTS

| | | | |
|---|---|---|---|
| 1,554,723 | 9/1925 | Hamilton | 299/31 |
| 3,306,055 | 2/1967 | Tabor | 61/85 |
| 3,581,507 | 6/1971 | Stevens | 61/85 |
| 3,650,116 | 3/1972 | Cunningham | 61/85 |
| 3,903,707 | 9/1975 | Folk | 61/85 |

*Primary Examiner*—Jacob Shapiro

*Attorney, Agent, or Firm*—Browning & Bushman

[57] ABSTRACT

A tunneling shield for shielding the area of a tunnel between first and second tunnel machine assemblies which are longitudinally, relative to the axis of the tunnel, movable relative to each other comprising a plurality of extendable and retractable support beams, the longitudinal axes of which are substantially parallel with the axis of the tunnel. The support beams may be disposed near the wall of the tunnel at circumferentially spaced intervals from each other an connected at each end to a first and second tunnel machine assembly by flexible joints. Each of the support beams may comprise first and second telescopically engagable members to effect extension and retraction of the support beams in response to relative movement between the first and second machine assemblies.

7 Claims, 6 Drawing Figures

FIG. 3
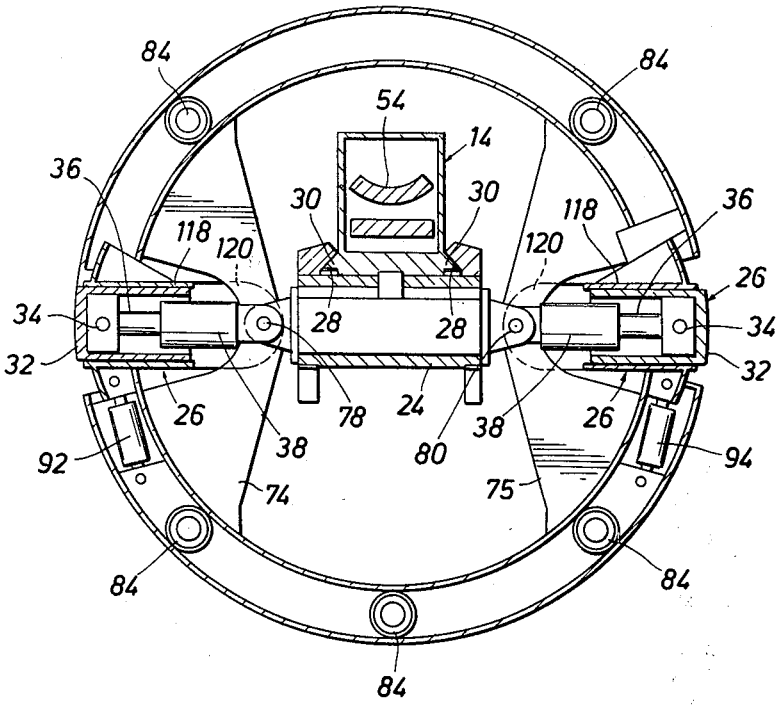
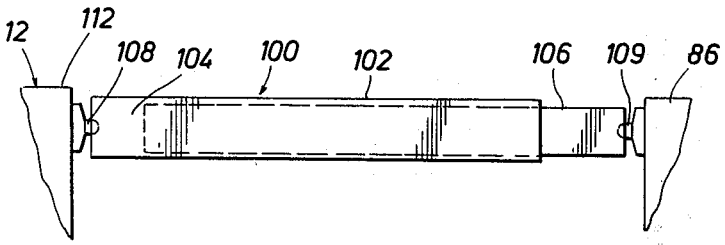
FIG. 4

TUNNELING SHIELD

CROSS-REFERENCE TO RELATED APPLICATIONS

This is a division of application Ser. No. 363,035, filed May 23, 1973, now U.S. Pat. No. 3,870,368.

The present invention may be utilized with a tunnel boring machine of the type disclosed in patent application Ser. No. 363,057, now U.S. Pat. No. 3,859,810, filed concurrently herewith.

BACKGROUND OF THE INVENTION

1. Field of the Invention

The present invention relates to the drilling of tunnels through earth or rock formations. In particular it pertains to tunneling shields for shielding portions of the tunnel at or near tunnel boring machines which are being used to drill such a tunnel.

2. Description of the Prior Art

Various types of tunnel boring machines are employed to drill tunnels through subterranean formations. One especially efficient type of tunnel boring machine comprises a cutterhead assembly, including a plurality of cutters mounted on its forward face for contacting the earth formation. The cutterhead assembly is rotatably mounted on a cutterhead support assembly. The cutterhead support assembly is in turn fixed to a main frame which extends axially away from the cutterhead support in a rearward direction. A gripper assembly is mounted on the main frame so that it can slide longitudinally therealong.

The gripper assembly may include a pair of grippers mounted on a carriage which is non-rotatable relative to the main frame. The grippers are radially extensible to engage the tunnel wall. The gripper and cutterhead support assemblies are connected by advancement means, such as piston and cylinder assemblies. When the grippers are engaged with the tunnel wall, the main frame, cutterhead support and cutterhead assemblies may be driven forward relative to the grippers by the advancing means to urge the cutters against the tunnel face. Simultaneously, the cutterhead assembly is rotated by suitable power means, moving the cutters across the face of the tunnel. The grippers remain fixed against the tunnel wall to provide reaction for the drilling forces. Buckets mounted along the periphery of the cutterhead, scrape along the invert of the tunnel picking up fragments of rock and dirt which have been broken from the tunnel face by the cutters. When the buckets reach the top of their circular path, they drop these cuttings onto a conveyor which transports them to the rear of the machine once they are removed from the tunnel.

Drilling proceeds in this manner until the main frame reaches the end of its travel with respect to the gripper assembly. At this time the grippers are retracted from the tunnel wall and the drive means is reversed to pull the gripper assembly forward along the main frame. Then the grippers are once again extended into engagement with the tunnel wall, and the cycle is repeated. This type of tunnel boring machine is described in detail in U.S. Pat. No. 3,596,445-Winberg and the above mentioned copending patent application Ser. No. 363,057, now U.S. Pat. No. 3,859,810.

One of the problems encountered in boring tunnels with such machines, or any other type of machine, is the problem of falling rock, dirt, etc. from the top or crown of the tunnel as drilling progresses. Many times the tunnel is lined behind the drilling machine or provided with some sort of roof support to prevent the tunnel from caving in and hinering operations, damaging the machine or injuring workers in the tunnel. However, it is difficult, if not almost impossible, to provide such linings or roof supports directly above the tunneling machine while drilling progresses. Thus, there is a possibility of rocks and dirt falling from the crown of the tunnel into the machine or on the workers operating such a machine.

In the type of machine previously discussed herein, this problem is particularly acute in the area of the tunnel between the gripper assembly and the cutterhead support assembly. Since the space between the gripper and cutterhead support assemblies varies considerably during the drilling cycle, it is extremely difficult to provide protection from falling rocks.

Various types of tunneling shields have been devised for protecting areas of tunnel boring machines during their operation. For example, U.S. Pat. No. 3,301,600 Pirrie et al. discloses a cylindrical shell-like shield which is mounted on the cutterhead support assembly. Such a shield provides good protection for the cutterhead support assembly but provides no protection behind the cutterhead support assembly. Tunnel liners must be installed to provide this protection.

Another shell type shield is disclosed in U.S. Pat. No. 3,377,105—Wallers. Although it does appear that some protection is provided between a cutterhead support assembly and rearward parts of the tunnel boring machine, the shield of Waller provides little flexibility and would not appear to permit angular movement of the cutterhead support assembly relative to other portions of the machine. Another tunneling shield is shown in U.S. Pat. No. 3,467,463—Pentith et al. However, the shield disclosed in this patent provides protection only over the main frame area. No shielding is provided between the main body of the machine and the cutter.

SUMMARY OF THE INVENTION

The tunneling shield of the present invention is primarily for shielding the area of a tunnel between first and second tunnel machine assemblies which are longitudinally, relative to the axis of the tunnel, movable relative to each other. The tunnel shield may include a plurality of extendable and retractable support beams, the longitudinal axes of which are substantially parallel with the axis of the tunnel. Each of the support beams are disposed near the wall of the tunnel at circumferentially spaced intervals from each other and may comprise a first tubular member telescopically receiving a second tubular member to effect extension and retraction of the support beams in response to relative movement between the first and second machine assemblies. The support beams are connected at each end by flexible joints to one or the other of the first and second tunnel machine assemblies.

Each of the tubular members are preferably provided with a cross-section of decreasing dimension from the outer periphery of the shield radially inwardly toward the tunnel axis so that the space between the support beams is no greater at the outer periphery than it is radially inwardly thereof. This prevents rocks or other material from being wedged between support beams. Yet some space is provided allowing dirt and small objects to fall through the shield.

Since the support beams are flexibly mounted, a relative angular movement of the tunnel machine assemblies, as well as longitudinal movement therebetween, is permitted. The tunneling shield of the present invention is particularly desirable for use with the type of machine previously described comprising a cutterhead support and cutterhead assemblies which are movable relative to a gripper assembly. With such a machine, one end of the shield is connected to the cutterhead support assembly and the other end is connected, in some fashion, to the gripper assembly. An arcuate support assembly may provide the connection between the shield and the gripper assembly. This arcuate support may be provided with sliding joints for lengthening and shortening of the arcuate support in response to radial movement of grippers of the gripper assembly. The arcuate support may also be provided with piston and cylinder assemblies for moving the arcuate support toward and away from the crown of the tunnel.

Thus, the tunneling shield of the present invention provides a means of shielding an area of the tunnel between two relatively longitudinal movable machine assemblies, such as the cutterhead support assembly and the gripper assembly of a particular type of tunnel boring machine. The shield also allows angular movement between such assemblies. Other features, objects and advantages of the invention will become apparent from the following detailed description of preferred embodiments in conjunction with the accompanying drawings.

BRIEF DESCRIPTION OF THE DRAWINGS

FIG. 3, taken along lines 3—3 of FIG. 2, is a transverse cross-sectional view primarily illustrating the gripper assembly of the tunnel boring machine;

FIG. 4 is a detailed side elevational view of a support beam of the tunneling shield of the present invention;

DESCRIPTION OF PREFERRED EMBODIMENTS

Figure 1:
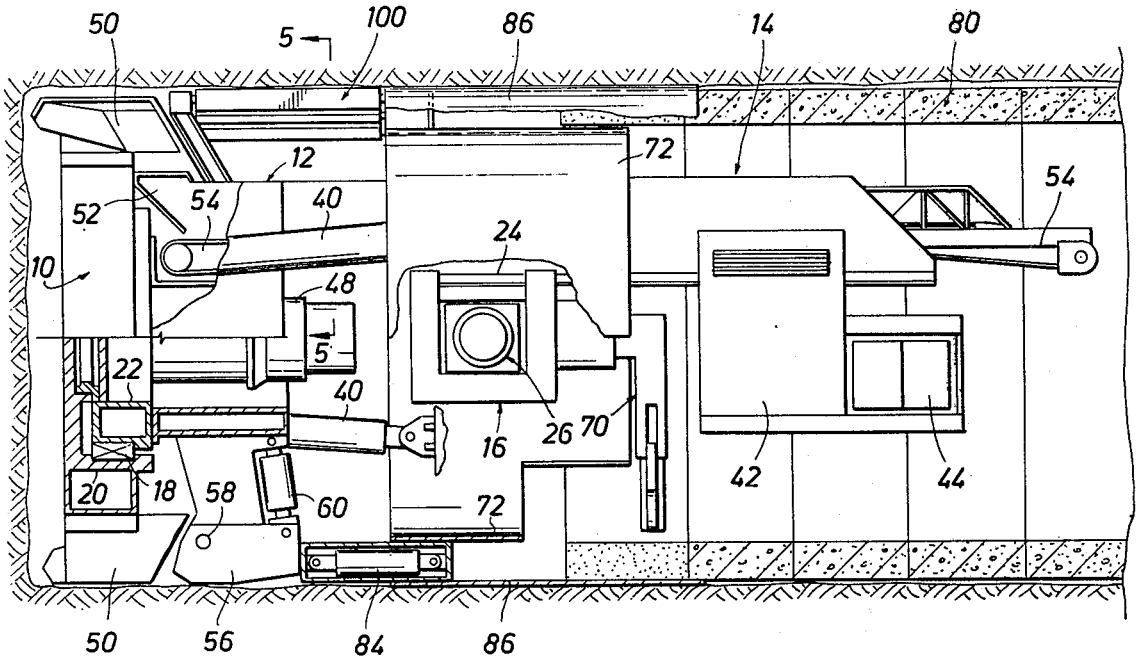
FIG. 1 is a side elevational view of a tunnel boring machine, with parts broken away and parts shown in section, employing a tunneling shield according to a preferred embodiment of the invention.
Figure 2:
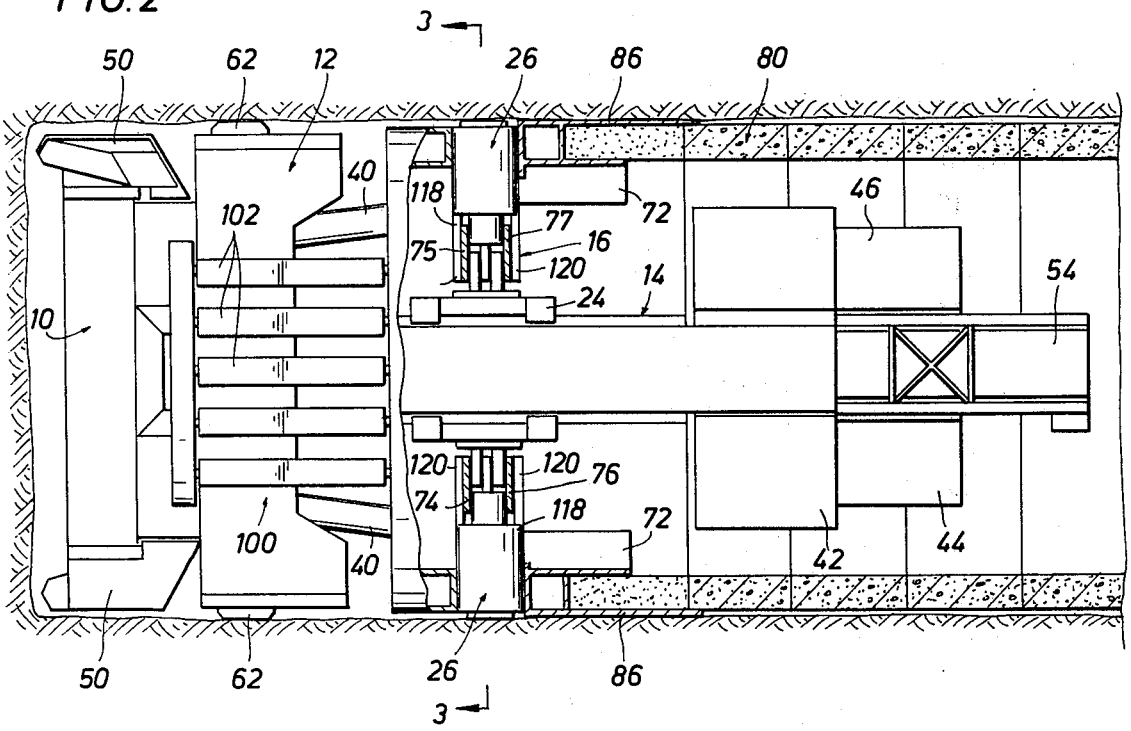
FIG. 2 is a top plan view of the machine of FIG. 1 with parts broken away and parts shown in section.

It is considered helpful in the understanding of the tunneling shield of the present invention to present here a brief general description of a type of tunnel boring machine with which the invention may be employed. Referring to FIGS. 1 and 2 it can be seen that the tunnel boring machine generally comprises a cutterhead assembly 10, a cutterhead support assembly 12, a main frame 14, and a gripper assembly 16. The cutterhead 10 is rotatably mounted on the cutterhead support 12 by means of a bearing assembly 18 disposed between a rearward extension 20 on the cutterhead 10 and a mating hub 22 on the cutterhead support assembly 12. The cutterhead support assembly 12 is in turn rigidly mounted on the forward end of the main frame 14 so that the cutterhead and cutterhead support assemblies and the main frame will move forward and backward as a unit.

The gripper assembly 14 (see also FIG. 3) comprises a carriage 24 and two grippers 26. A pair of rails 30 are integrally formed on opposite sides of the lower part of the main frame 14. Raceways 28 on the carriage 24 are configured to fit and ride on the rails 30 so that the gripper assembly 16 can move longitudinally relative to the main frame 14 and its connected part. The fit and configuration of rail 30 in raceways 28 prevents lateral movement and rotation of the carriage 24 relative to the main frame 14 and, as will be seen, provides the means by which torque reactions are transmitted from the cutterhead to the gripper assembly.

The grippers 26 are mounted on opposite sides of the carriage 24. Each of the grippers 26 comprises an integral shoe 32 pivotally connected at 34 to the outer end of a hydraulic ram 36. The ram 36 is mounted in a cylinder 38 and is selectively radially extensible and retractable therein. When the rams 36 are extended, the shoes 32 contact the side walls of the tunnel in which the machine is disposed and in which it is progressively drilling.

Advancing means, comprising hydraulic cylinder assemblies 40, is disposed between the cutterhead support assembly 14 and the gripper assembly 16. In some machines the cylinder assemblies may be connected directly to the gripper assembly. In the exemplary embodiment they are connected to related apparatus, shell 72, to be described hereafter. At the rear of main frame 14 and on opposite sides thereof are a cab 46 for the machine operator and a compartment 42 for housing various equipment such as electrical equipment, pumps for the hydraulic fluid, etc. Other auxiliary compartments such as 44 may also be provided in this vicinity.

Drilling generally proceeds as follows. The grippers 26 are extended and firmly engaged with the tunnel wall. This provides reaction for the forces of the advancing hydraulic cylinders 40. Hydraulic cylinder assemblies 40 are extended to urge the cutterhead assemblies 10 against the face of the tunnel. Simultaneously, rotary drive means, such as motor 48, is operated to rotate the cutterhead assembly 10 on the cutterhead support assembly 12. The gripper assembly 16 provides reaction for the torque developed. A plurality of cutters (not shown) are mounted on the front of the cutterhead assembly 10 to engage the formation. These cutters are pressed into and dragged along the face of the tunnel by the advancing means and the rotary drive of the cutterhead assembly. The cuttings break away and fall to the floor of the tunnel.

A plurality of buckets 50 are mounted on the outer edge of the cutterhead assembly 10 and rotate therewith. These buckets 50 are configured to scrape the invert of the tunnel as they pass along the bottom of their arc of travel and collect the fragments which have broken from the formation. When the buckets 50 reach the top of their arc they dump these fragments into a chute 52 in the cutterhead support assembly 12. The chute 52 directs the fragments onto an endless belt type conveyor 54 which runs longitudinally through the main frame 14 and carries the fragments to the rear of the machine where they can be removed from the tunnel.

Drilling proceeds in this manner until the main frame 14 had reached the end of its forward travel on the gripper carriage 24 (or until it has reached any other desired point in its travel). At this time the grippers 26 are retracted from the tunnel wall and the cylinder assemblies 40 are reversed to pull the gripper assembly 16 forward along the main frame 14. The grippers 26 are again extended to anchor the gripper assembly relative to the tunnel wall and drilling is resumed.

The tunnel boring machine shown is of the "fixed head" type, i.e. the cutterhead support assembly 12 does not move relative to the main frame 14. To steer this type of machine, a plurality of shoes are provided on the cutterhead support assembly. These shoes can be urged against the tunnel walls to move the cutterhead support assembly 12 in any desired direction. The bottom shoes 56, which affect vertical steering, are pivoted at 58 to swing in a close to vertical plane and a hydraulic ram assembly 60 is provided to pivot the rear end of shoe 56 around the pin 58. Because the cutterhead support assembly 12 always rests on the shoe 56, a downward motion of the rear end of the shoe moves the cutterhead support assembly 12 upwardly. Similarly, upward motion of the rear end of the shoe 56 moves the cutterhead support assembly 12 downwardly.

For horizontal steering, a pair of shoes 62 are provided on opposite sides of the cutterhead support assembly 12. The shoes 62 are mounted in slideways (not shown) in the cutterhead support assembly 12 and can be urged radially outward by hydraulic ram assemblies (not shown). Extension of the shoe 62 on the left hand side of the machine, for example, turns the machine to the right by shoving it away from the left hand tunnel wall.

In another type of tunnel boring machine, known as the "swivel head" type, the cutterhead support assembly is mounted on a main frame by means of a ball joint or the like so that it can swivel relative to the main frame. In this type of machine, the steering is accomplished by a plurality of hydraulic cylinder assemblies or the like, operative to pivot the cutterhead support assembly to various attitudes on the main frame. Although the "fixed head" type machine is shown and described herein as exemplary, it should be understood that the invention is equally applicable to the swivel head type machine and to machines having various other modifications.

The machine illustrated in FIGS. 1-3 also includes an erector assembly indicated generally at 70 which is fixed to the gripper assembly 16. The erector assembly 70 comprises inner and outer shells 72 and 86, respectively, supported by transverse gussett plates 74, 75, 76, and 77. The gussett plates 75–77 are supported on the gripper carriage 24 by respective pivot pins 78 and 80. A complete description of the erector assembly 70 is given in the aforementioned application Ser. No. 363,057, now U.S. Pat. No. 3,859,810. For present purposes it is sufficient to understand that the erector assembly 70 is used for erecting short cylindrical sections of tunnel lining 80. The tunnel lining 80 is constructed simultaneously with drilling and provides cave-in protection rearwardly of the tunnel boring machine. In addition the tunnel lining 80 may provide reaction for auxillary advancing means of the tunnel boring machine. Hydraulic thrust assemblies 84 are mounted on the outer surface of the inner shell 72 forward of the section of tunnel lining being constructed. These assemblies have extensible parts which may be used for axially packing the newly formed section of the tunnel lining.

These thrust assemblies 84 also provide auxillary drive means for the tunnel boring machine and may be used with or instead of the primary drive means hydraulic cylinder 40. Under good drilling conditions, the grippers 26 provide adequate reaction for the drilling forces. However, if drilling conditions are such that the grippers cannot provide adequate reaction, alternate modes of operation may be employed. In one such mode, the gripper assembly 16 is fixed relative to the cutterhead support assembly 12 and thus to the cutterhead assembly 10 and main frame 14, by locking hydraulic cylinders 40. The thrust assemblies 84 can then be used to advance the machine against the tunnel face by thrusting against the axial edge of the tunnel lining 80. In another mode, the grippers might be engaged with the tunnel wall to provide part of the reaction force and backed up by the thrust assemblies 84 locked in position against the edge of the tunnel lining 80. Other variations are possible. For example, if an especially long drilling stroke were desired, both the cylinder assemblies 40 and the auxillary drive thrust assemblies 84 could be used, either simultaneously or consecutively.

The grippers 26 are pivotally mounted on opposite sides of the carriage 24 by spaced apart pins 78 and 80. These same pins 78 and 80 also pivotally mount the gusset plates 74, 75, 76 and 77 which support the shells 72 and 86. Each of the grippers 26 rides in a slideway 118, and the slideways 118 each have at their radial inner ends a pair of ears 120 which extend radially inwardly for pivotal connection to one of the pins 78 or 80.

In the particular tunnel boring machine illustrated herein, a pair of roll piston and cylinder means 92 and 94 are mounted on opposite sides of the gripper assembly, each having one part attached to the adjacent slideway 118 and the other part attached to the shells 72 and 86. When the grippers 26 are not in engagement with the tunnel wall, the piston and cylinder means 92 and 94 can be used to pivot the grippers 26 about their respective pins 78 and 80 so as to align them properly with the tunnel wall. When the grippers 26 are in engagement with the tunnel wall, the piston and cylinder means 92 and 94 can be used for correct for "roll" of the tunnel boring machine, i.e. rotation of the machine about its longitudinal center caused by gradual creeping of the gripper shoes 32 along the tunnel wall. If, for example, the machine has rotated clockwise, the piston and cylinder 92 is extended and the piston and cylinder 94 is contracted. This rotates the shells 72 and 86 in a counterclockwise direction. When the shells rotate, the pin 78 moves downwardly and the pin 80 moves upwardly straightening the carriage 24. Because the rails 30 and slideways 28 prevent relative rotation of the carriage 24 and the main frame 14, the entire machine is straightened by this movement of the pins 78 and 80. The fact that the outer shell 86 lies closely adjacent to the tunnel wall and bears against it, ensures that the pin 78 and 80 will move as described above when the shells 72 and 86 are rotated. After the machine has been straightened the grippers 26 can be retracted from the tunnel and realigned by means of piston and cylinder means 92 and 94. It is not necessary to employ the tunneling shield of the present invention with a machine having such a roll correction feature. However, the tunneling shield of the present invention permits such roll correction whereas other types of tunneling shields may not.

As previously mentioned, the tunneling machine in the present machine is provided with a tunneling shield 100 which extends over the area of the tunnel between the cutterhead support assembly 12 and gripper assembly 16. The purpose of the tunneling machine shield 100 is to prevent large rocks from falling from the crown of the tunnel and injuring personnel or damaging the equipment therebelow.

Figure 5:
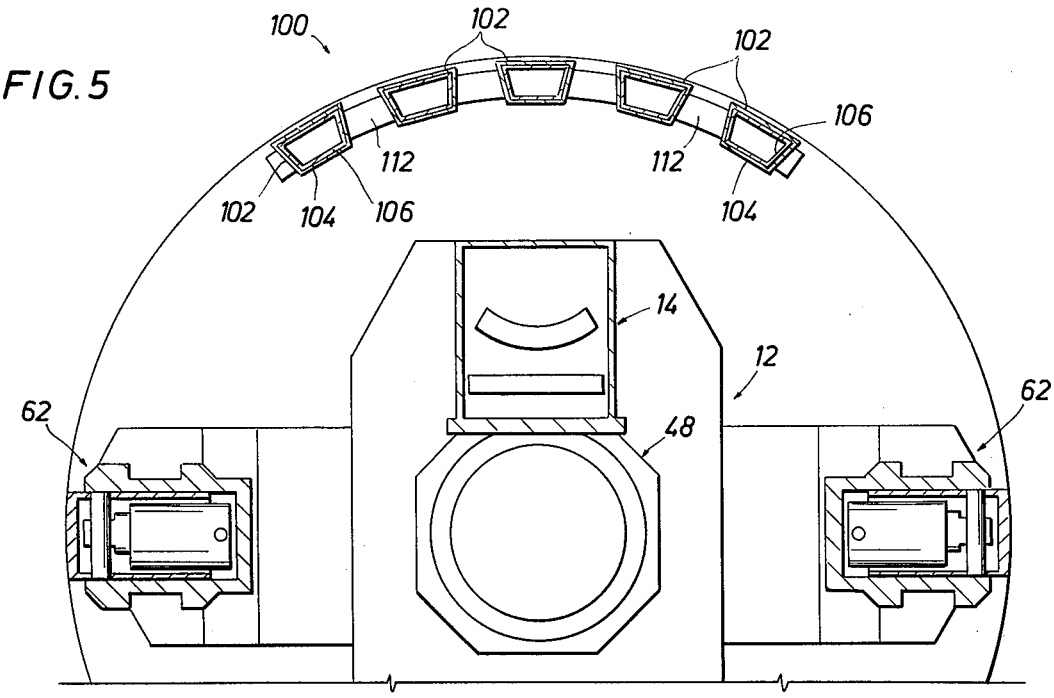
FIG. 5, taken along line 5—5 of FIG. 1, is partial transverse cross-section view of the tunnel boring machine of FIGS. 1–4 illustrating the tunneling shield.

Referring primarily to FIGS. 4 and 5, the tunneling shield 100 comprises a plurality of extendable and retractable support beams 102, the longitudinal axes of which are substantially parallel with the axis of the tunnel. The support beams are disposed near the wall of the tunnel at circumferentially spaced intervals from each other. Each beam comprises a first tubular member 104 telescopically receiving a second member 106 for effecting extension and retraction of the support beam in response to relative movement between cutterhead support assembly 12 and shell 86 which is attached to the gripper assembly 16. One tubular member 104 is connected by a flexible joint 108 to an arcuate support member 112 on the cutterhead support assembly 12 and the other member 106 is connected by a similar flexible joint 109 to the outer shell 86. Thus, longitudinal displacement between cutterhead support assembly 12 and the gripper assembly 16, as well as annular and rotational movements, is accommodated by the extensible and retractable beams 102 and their flexible joint connections 108 and 109.

Referring primarily to FIG. 5, it can be seen that the cross sections of the tubular members 104 and 106 are illustrated as being trapezoidal. Thus, they are of decreasing dimensions from the outer periphery of the shield radially inwardly toward the tunnel axis so that the space 110 between each of the support beams is no greater at the outer periphery than it is radially inwardly thereof. This prevents rocks or other objects from becoming wedged between a pair of support beams 102. If a rock is small enough to enter the space 110 it will fall to the bottom of the tunnel. In other cross-sectional configurations, such as circular, such a rock might be wedged between the support beams 102. Although the cross sections are illustrated as being trapezoidal, many other cross-sectional configurations may be used.

During tunnel boring operations, the gripper assembly 16 is stationary relative to the tunnel and the cutterhead support assembly 12 is advanced forwardly by means of the advancing piston and cylinders 40. As the cutterhead support assembly 12 advances forwardly, the support beams 102 of the tunneling shield 100 are extended providing continuous shielding protection throughout the advance. When the advancing stroke is completed, the gripper assembly 16 is disengaged from the tunnel wall and pulled forwardly along the main frame 14 toward the cutterhead support assembly 12. In this motion, the support beams 102 are retracted, again providing continuous shielding of the area of the tunnel between the cutterhead support assembly 12 and the gripper assembly 16. The gripper assembly 16 reengages the tunnel wall and the cycle is repeated. Thus protection of personnel and equipment is continuously afforded.

Figure 6:
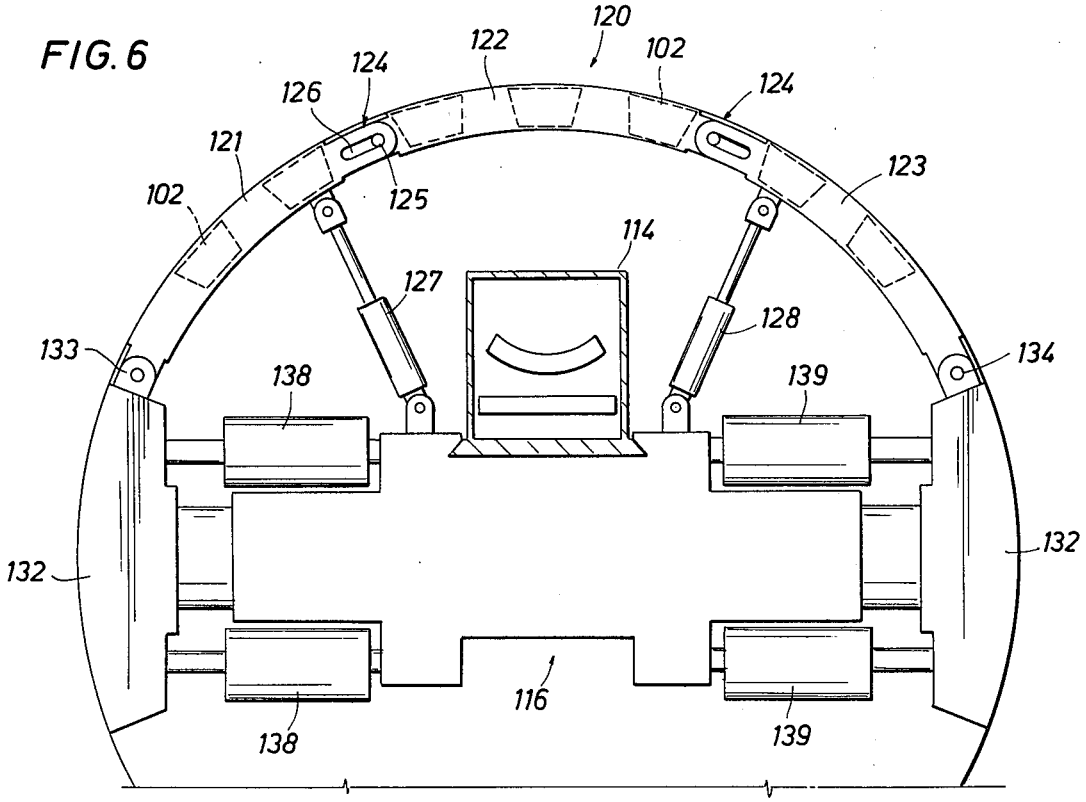
FIG. 6 is a partial transverse cross-section through another tunnel boring machine, illustrating an alternate mounting arrangement for the tunneling shield of the present invention.

Many types of tunnel boring machines are not provided with a shell member such as the one 86 which is attached to the gripper assembly 16 of the machine illustrated in FIGS. 1–5. For this reason, it may be necessary to provide an alternate means of mounting the tunneling shield 100 on the machine. Such an alternate mounting means is illustrated in FIG. 6 for use with a machine having a gripper assembly 116 similar to the one shown therein. As in the previously discussed machine, the gripper assembly 116 is slidably mounted on a main beam 114 and is provided with a pair of gripper shoes 132. Hydraulic rams 138 and 139 are provided for extending the gripper shoes 132 radially outwardly into engagement with the tunnel walls. They also retract the shoes 132 from engagement with the tunnel walls when so desired.

The alternate means for mounting the tunneling shield 100 comprises arcuate support assembly 120 which is connected at its ends by pivots 133 and 134 to the gripper shoes 132. The arcuate support assembly 120 may include a plurality of arcuate segments 121, 122, 123 connected by sliding joints 124. These sliding joints may comprise a pin member 125 attached to one segment 122 and an arcuate slot 126 in another segment 121. Thus, the arcuate support assembly 120 may be lengthened or shortened within certain predetermined limits. One end of the support means 102 (shown by dotted lines) may be connected to respective segments 121–123 by suitable universal joints, such as 109 as shown in FIG. 4.

The purpose of the sliding joints 124 is of course to allow for retraction and extension of gripper shoes 132. In the extended position shown in FIG. 6, the arcuate support assembly 120 lies closely adjacent to the wall of the tunnel. It can be seen that if the arcuate support assembly 130 were rigid it would either prevent retraction of shoes 132 or be bent when the shoes were retracted. Furthermore, a simple pivot connection would not be suitable since the middle segment 122 would be pushed into the walls of the tunnel crown. The sliding connection 124 prevents such occurrences.

In addition, a pair of thrust cylinders 127, 128 may be connected between the segments and the gripper carriage 124. This provides a means for positioning the arcuate assembly 122 immediately adjacent to and away from the wall of the tunnel in response to the extension and retraction of the thrust cylinders 127 and 128.

The construction of shield 100 when used in conjunction with an arcuate assembly similar to 120 described herein would not be materially different from that previously described. Furthermore, the tunneling shield of the present invention could be used with many other support configurations. Most importantly, the tunneling shield of the present invention offers continuous shielding of the variable area of tunneling lying between the two tunneling machine assemblies which are longitudinally movable relative to each other within the tunnel. Although at least two embodiments of the invention have been described herein, many other modifications may be made without departing from the spirit of the invention. It is therefore intended that the scope of the invention be limited only by the claims which follow.

We claim:

1. A tunneling shield for shielding the area of a tunnel between first and second tunnel machine assemblies which are longitudinally, relative to the axis of said tunnel, movable relative to each other comprising: a plurality of extendable and retractable support beams the longitudinal axes of which are substantially parallel with the axis of said tunnel, said support beams being disposed near the wall of said tunnel at circumferentially spaced intervals from each other.

2. A tunneling shield as set forth in claim 1 in which opposite ends of each of said support beams are connected by flexible joint means to said first and second machine assemblies.

3. A tunneling shield as set forth in claim 1 in which each of said support beams comprises a first member telescopically receiving a second member to effect extension and retraction of said support beams in response to relative movement between said first and second machine assemblies.

4. A tunneling shield as set forth in claim 3 in which said support beam first and second members are tubular members whose cross sections are of decreasing dimensions from the outer periphery of said shield radially inwardly toward said tunnel axis so that the interval between said support beams is no greater at said outer periphery than it is radially inwardly thereof.

5. A tunneling shield as set forth in claim 1 in which one end of each of said support beams is attached to arcuate support means attached to one of said machine assemblies, said arcuate support means lying in a plane, substantially perpendicular to said axis of said tunnel and being provided with sliding joints to permit lengthening and foreshortening of said arcuate support means in response to radially movements of portions of said one machine assembly to which said arcuate support means is attached.

6. A tunneling shield as set forth in claim 5 in which said arcuate support means comprises a plurality of arcuate segments connected by said sliding joints, said sliding joints comprising a pin member on one of said segments engaging an arcuate slot on an adjacent segment and also permitting pivoting of said one segment relative to said adjacent segment.

7. A tunneling shield as set forth in claim 6 in which said arcuate support means is connected to extendable and retractable piston and cylinder means by which said arcuate support means may be positioned immediately adjacent to and away from the crown of said tunnel in response to extension and retraction of said piston and cylinder means.

* * * * *

UNITED STATES PATENT OFFICE
CERTIFICATE OF CORRECTION

Patent No. 3,979,921 Dated 9-14-76

Inventor(s) Douglas F. Winberg, Norman D. Dyer

It is certified that error appears in the above-identified patent and that said Letters Patent are hereby corrected as shown below:

In column 4, line 67, delete the word "had" and insert therefor --has--.

In column 6, line 11, after the word "locking" insert --the--.

In column 8, line 32, delete the number "130" and insert therefor --120--.

In column 8, line 52, delete the word "tunneling" and insert therefor --tunnel--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*